US006265369B1

(12) United States Patent
Falotico et al.

(10) Patent No.: US 6,265,369 B1
(45) **Date of Patent: *Jul. 24, 2001**

(54) HIGH CARBONATE-LOW PHOSPHATE POWDER LAUNDRY DETERGENT PRODUCT WITH IMPROVED COLD WATER RESIDUE PROPERTIES

(75) Inventors: Anthony J. Falotico, Doylestown, PA (US); Bruce R. Conley, Hamilton, NJ (US); Louis R. Mazzola, Mahwah, NJ (US); Herman L. Marder, Princeton, NJ (US)

(73) Assignee: Church & Dwight Co., Inc., Princeton, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/449,956

(22) Filed: May 25, 1995

Related U.S. Application Data

(63) Continuation-in-part of application No. 08/936,182, filed on May 9, 1995.

(51) Int. Cl.[7] ..... C11D 17/00

(52) U.S. Cl. ..... 510/446; 510/424; 510/428; 510/509; 510/511

(58) Field of Search ..... 252/135, 531, 252/534, 550, 174.14, 174.13, 558

(56) References Cited

U.S. PATENT DOCUMENTS

| | | | | |
|---|---|---|---|---|
| 3,868,336 | * | 2/1975 | Mazzola et al. | 252/527 |
| 4,464,292 | * | 8/1984 | Lengyel | 252/532 |
| 5,180,515 | * | 1/1993 | Boucher et al. | 252/135 |
| 5,443,751 | * | 8/1995 | Mazzola | 252/174.13 |
| 5,482,646 | * | 1/1996 | Mazzola | 252/174.13 |

* cited by examiner

*Primary Examiner*—Necholus Ogden
(74) *Attorney, Agent, or Firm*—Irving M. Fishman

(57) ABSTRACT

This invention provides a high carbonate-low phosphate powder laundry detergent formulation which can be utilized in cold water fabric laundering with a minimized remainder of undissolved detergent residue in the wash water. An essential aspect of the laundry detergent formulation is a content of a partially sulfated and neutralized blend of ethoxylated alcohol surfactant constituents. A preferred type of surfactant ingredient is a Neodol 23-3 derived type of blend which is 50–65 percent sulfated and neutralized.

10 Claims, 1 Drawing Sheet

Figure 1:
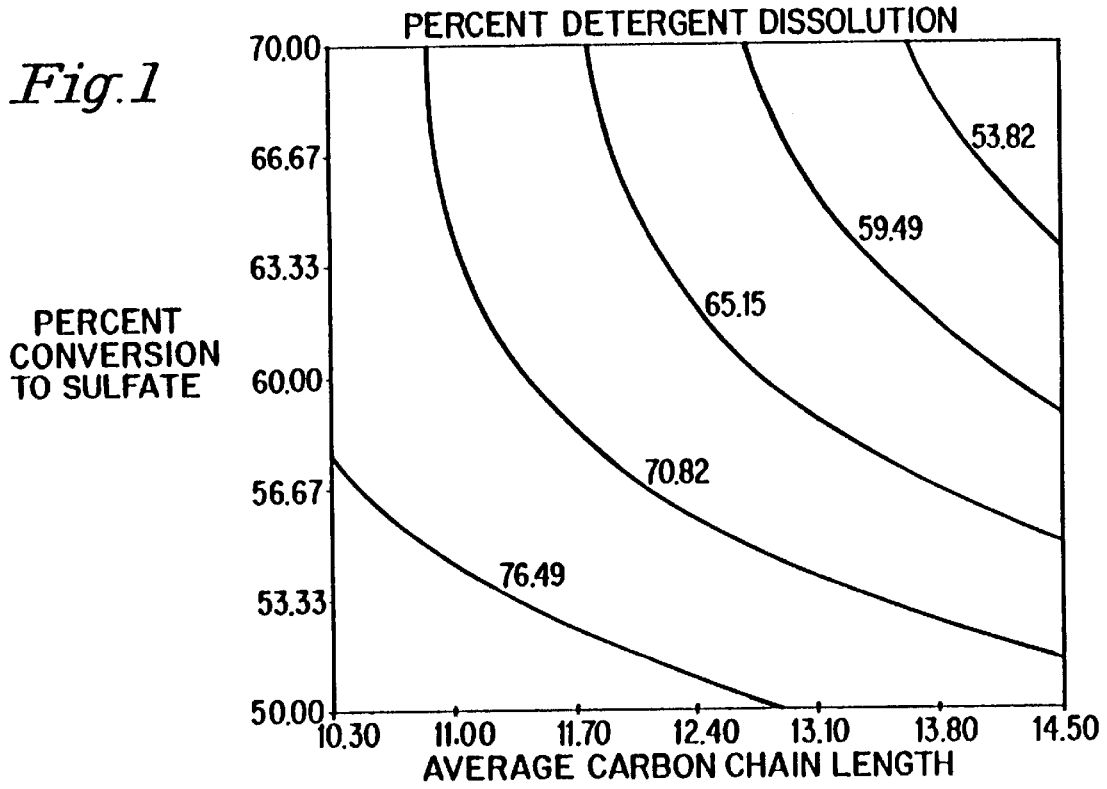

HIGH CARBONATE-LOW PHOSPHATE POWDER LAUNDRY DETERGENT PRODUCT WITH IMPROVED COLD WATER RESIDUE PROPERTIES

CROSS-REFERENCE TO RELATED APPLICATION

This patent application is a continuation-in-part of patent application Ser. No. 08/936,182 , filed May 9, 1995; incorporated by reference.

BACKGROUND OF THE INVENTION

Heavy duty powder detergent compositions for home use fabric laundering generally perform well and are widely accepted. With the increasing trend to cold water washing of fabrics at wash water temperatures below about 60° F. for energy conservation, commercial laundry detergent compositions tend to leave a cold water residue (CWR) of undissolved detergent solids after completion of the wash machine cycles.

The detergency of powder detergent compositions in fabric laundering applications is directly affected by the hardness of the wash water. Control of water hardness typically is achieved with detergency builders, such as water-soluble sequestering builders, water-insoluble ion exchange builders, and water-soluble precipitating builders.

Sodium carbonate is a preferred detergent builder because of cost considerations, but it has inherent disadvantages. There are difficulties associated with encrustation, and cold water solubility of the detergent particles under conventional fabric washing conditions. Also, precipitated calcium carbonate tends to coat undissolved detergent particles.

Particularly in the case of cold water laundering of fabrics, the coating of detergent particles with precipitated calcium carbonate suppresses dissolution of the sodium carbonate ingredient. This results in a substantial loss of detergency building activity, and there is a consequential remainder of a cold water residue of undissolved detergent solids.

Laundry detergent formulations which have been developed for use in cold water washing of fabrics are described in U.S. Pat. Nos. 4,196,095; 4,530,774; and 4,695,284.

U.S. Pat. No. 4,464,292 is of background interest with respect to a detergent active surfactant blend which is a novel ingredient of a present invention powder laundry detergent composition.

U.S. Pat. No. 5,180,515 is of background interest with respect to a present invention powder laundry detergent composition which has a content of potassium salt for improvement of cold water residue properties.

There is continuing interest in the development of heavy duty laundry detergents which exhibit improved properties for cold water laundry applications.

Accordingly, it is an object of this invention to provide a high carbonate-low phosphate powder detergent composition which performs with a minimized amount of residual undissolved detergent solids under cold water fabric laundering conditions.

It is a further object of this invention to provide a novel nonionic/anionic surfactant blend composition which contributes improved cold water residue properties as an ingredient in a heavy duty powder, or improves dispersibility of a liquid laundry detergent product.

Other objects and advantages of the present invention shall become apparent from the accompanying description and examples.

DESCRIPTION OF THE INVENTION

One or more objects of the present invention are accomplished by the provision of a powder laundry detergent composition with improved cold water residue properties, which is a granulated blend of ingredients comprising (1) between about 40–90 weight percent of a water-soluble detergent builder ingredient wherein at least 72 weight percent of the detergent builder ingredient is sodium carbonate; and (2) between about 5–40 weight percent of a detergent active ingredient which is a surfactant blend comprising (a) between about 40–80 weight percent, based on the surfactant weight, of an anionic salt compound corresponding to the formula:

$$R—O—(CH_2CH_2O)_n—SO_3M$$

where R is a $C_{10}$–$C_{15}$ alkyl group, n is an average number of ethoxylate groups between about 1–9, and M is an alkali metal or ammonium cation, and (b) between about 20–60 weight percent, based on surfactant weight, of a nonionic compound corresponding to the formula:

$$R—O—(CH_2CH_2O)_n—H$$

where R is a $C_{10}$—$C_{15}$ alkyl group, and n is an average number of ethoxylate groups between about 1–9; (3) between about 0–12 weight percent of water-soluble potassium salt; and (4) less than about 5 weight percent of phosphate salt.

The detergent active surfactant blend ingredient of a present invention laundry detergent product preferably has a content between about 50–65 weight percent of anionic sulfate salt compound, based on surfactant weight, and most preferably between about 50–60 weight percent.

As described more fully hereinafter, a present invention laundry detergent product exhibits excellent cold water residue properties when it includes the above represented surfactant blend composition as an ingredient, and the R alkyl group in the nonionic and anionic formulas is a $C_{10}$–$C_{15}$ alkyl substituent, and preferably is a $C_{12}$–$C_{14}$ alkyl or $C_{12}$–$C_{13}$ alkyl mixture.

Suitable water-soluble detergent builder compounds for a present invention laundry detergent product as defined herein include alkali metal and ammonium carbonates, bicarbonates, sesquicarbonates, silicates, phosphates, orthophosphates, pyrophosphates, tripolyphosphates, silicates, borates, and the like. Sodium and potassium carbonates, bicarbonates and sesquicarbonates are illustrative of preferred types of inorganic salt detergent builder compounds. A present invention laundry detergent product typically has a detergent builder content between about 0.1–4.5 weight percent of phosphate salt, and preferably has a content less than about 2 weight percent of phosphate salt.

Other types of detergent builders include sequestering compounds such as alkali metal and ammonium salts of nitrilotriacetate, polyhydroxysulfonate, oxydisuccinate, polysaccharide carboxylate, and the like; and ion-exchange compounds such as amorphous and crystalline aluminosilicates; as disclosed in U.S. Pat. No. 3,868,336, U.S. Pat. No. 4,473,485 and U.S. Pat. No. 4,695,284, incorporated by reference.

A present invention laundry detergent product can include a content of potassium salt ingredient of the type disclosed in U.S. Pat. No. 5,180,515 (incorporated by reference), for enhancing the cold water residue properties Qf the laundry detergent product.

In a preferred embodiment a present invention laundry detergent product has a content between about 0.5–10 weight percent of inorganic potassium salt. Suitable inorganic salts include water-soluble compounds such as potassium carbonate, potassium bicarbonate, potassium chloride, potassium sulfate, and the like.

The term "water-soluble" as employed herein refers to a chemical compound which has a solubility of at least about 2 grams per 100 grams of water at 25° C.

A present invention laundry detergent product can contain other optional detergent adjuncts, which include lather boosters such as alkanolamines, lather depressants such as alkyl phosphates or silicones, anti-redeposition agents such as sodium carboxymethylcellulose, oxygen-releasing bleaching agents such as sodium perborate or sodium percarbonate, fabric softening agents, fluorescent agents, perfumes, enzymes, germicides, colorants, and the like.

A preferred type of anti-redeposition agent is sodium polyacrylate having a molecular weight of 2000–50,000.

It is generally desirable to include a sodium or potassium silicate ingredient in the laundry detergent composition to provide buffering capacity and to prevent corrosion of metal parts in washing machines.

The novel detergent active surfactant blend ingredient of a present invention laundry detergent product is prepared by a partial sulfation procedure similar to that described in U.S. Pat. No. 4,464,292, incorporated by reference.

In a typical sulfation procedure, a nonionic ethoxylated alcohol mixture, such as Neodol 23-3 (Shell), is admixed with 96–100% concentrated sulfuric acid, in a proportion of about 1–2 moles of sulfuric acid per mole of nonionic ethoxylated alcohol mixture. The exothermic reaction admixture is maintained at a temperature between about 120°–180 ° F. for a sufficient period between about 0.5–45 minutes to convert about 40–80 weight percent of the initial ethoxylated alcohol mixture to a sulfate ester derivative.

The resulting partially sulfated nonionic ethoxylated alcohol blend is a liquid mixture of residual unsulfated ethoxylated alcohols, and sulfated ethoxylated alcohols, and lesser quantities of residual unsulfated unethoxylated alcohols, and sulfated unethoxylated alcohols.

A commercial nonionic ethoxylated alcohol product such as Neodol 23-3 is composed of a liquid mixture of $C_{12}$–$C_{13}$ alcohols which have an average content of three ethoxylate groups per alcohol molecule. A commercial nonionic ethoxylated alcohol product such as Neodol 23-3 typically has a content of up to about 20 weight percent of unethoxylated alcohols such as $C_{12}$–$C_{13}$ alcohols. Nominally 24-3 refers to a mixture of $C_{12}$–$C_{14}$ alcohols which have an average content of three ethoxylate groups per alcohol molecule.

The partially sulfated surfactant blend is neutralized with a basic reagent such as alkali metal or ammonium hydroxide or carbonate.

For purposes of the present invention, the neutralization of the partially sulfated surfactant blend preferably is effected by dry mixing of the surfactant blend with the other ingredients of a present invention powder laundry detergent formulation.

The following description illustrates a typical process for preparation of a present invention granulated powder laundry detergent product.

Soda ash is fed into a milling system to ground the soda ash into a fine powder. The soda ash powder is fed into a continuous blender, where the liquid partially sulfated surfactant blend (e.g., Neodol 23-3) is sprayed onto the soda ash powder. The final laundry detergent product has superior cold water residue properties when the liquid surfactant blend is evenly distributed throughout the soda ash powder during this initial blending stage.

The resultant detergent ingredient combination is agglomerated by spraying with water to increase particle size. The damp product is passed through a fluid bed dryer where approximately one half of the moisture is removed.

The product is discharged from the dryer through cooler beds. After cooling, the product is fed onto a screw conveyor where ingredients such as carboxymethylcellulose, sodium tripolyphosphate, sodium bicarbonate and brightener are added from gravimetric feeders. Perfume is sprayed onto the granulated detergent stream with a diaphragm pump.

The finished product is passed through a Rotex screener to remove oversize particles (+6 mesh), and then the screened product is transferred to a package filling unit.

The superior cold water residue properties of a present invention granulated laundry detergent product mainly are attributable to the content of the partially sulfated and neutralized nonionic/ionic surfactant ingredient which has the specifications described herein. The inclusion of a potassium salt ingredient provides further enhancement of the cold water residue properties.

As demonstrated in Example II, a present invention detergent active surfactant blend contributes superior cold water residue properties to a powder detergent composition when the partially sulfated and neutralized nonionic/anionic constituents of the surfactant blend ingredient are limited to specific chemical structures.

An essential aspect of the surfactant blend is an R radical which is a linear $C_{10}$–$C_{15}$ alkyl group, as represented above in the nonionic and anionic structural formulas.

A surf actant blend in which R is a $C_{12}$–$C_{14}$ or $C_{12}$–$C_{13}$ mixture contributes a higher degree of cold water residue improvement to a laundry detergent product, as compared to a surfactant blend in which R is a $C_{12}$–$C_{15}$ mixture. Neodol 23-3 is a more effective ethoxylated alcohol starting material relative to cold water residue improvement than is Neodol 25-3. Neodol 23-3 is a $C_{12}$–$C_{13}$ alcohol mixture which has an average content of three ethoxylate groups per alcohol molecule. Neodol 25-3 is a $C_{12}$–$C_{15}$ alcohol mixture which has an average content of three ethoxylate groups per molecule.

Another essential aspect of the surfactant blend nonionic/anionic constituents is an average number (n) of ethoxylate groups between about 1–9 per molecule. As demonstrated in Example II, the ability to improve cold water residue properties of a laundry detergent increases as the average number of ethoxylate groups in the nonionic/anionic constituents increases, e.g., when the average number increases between about 2 and 6.

A present invention laundry detergent composition was developed to reduce or eliminate the residual detergent solids which remain undissolved under normal cold water fabric laundering conditions in home wash machines.

After a laundry load and detergent powder are placed in a home wash machine, the initial wash water normally is added to the wash machine contents over a period of about five minutes. The machine agitator is off during the initial wash water addition, thereby providing a relatively static medium around the detergent particles. This is a critical phase of the laundering operation with respect to the eventual quantity of cold water residue which remains undissolved.

With conventional powder laundry detergents, the water hardness causes a precipitate of calcium carbonate to form a water-insoluble coating on the surfaces of the detergent granules, which decreases dissolution of the sodium carbonate contained in the core of the calcium carbonate-coated detergent granules. This has the effect of limiting the detergency power of the detergent active ingredients, and increasing the quantity of cold water residue remaining after completion of the laundering cycles.

A present invention granular laundry detergent composition can be utilized in cold water fabric washing under home use conditions with little or no cold water residue remaining after completion of the laundering cycles. It appears that the novel nonionic/anionic surfactant ingredient in the detergent granules functions to accelerate the rate of sodium carbonate dissolution under cold water laundering conditions, so that little or no cold water residue of undissolved detergent solids remains after completion of the laundering cycles.

The following examples are further illustrative of the present invention. The components and specific ingredients are presented as being typical, and various modifications can be derived in view of the foregoing disclosure within the scope of the invention.

FIG. 1 is a graphic representation of the effect of respective partially sulfated and neutralized surfactant blends on the weight percent dissolution of laundry detergent solids under controlled test conditions. FIG. 1 illustrates the effect of average carbon chain length in nonionic/anionic surfactant compounds on laundry detergent solids dissolution, relative to the percent conversion of ethoxylated alcohol to a sulfated sodium salt derivative.

Figure 2:
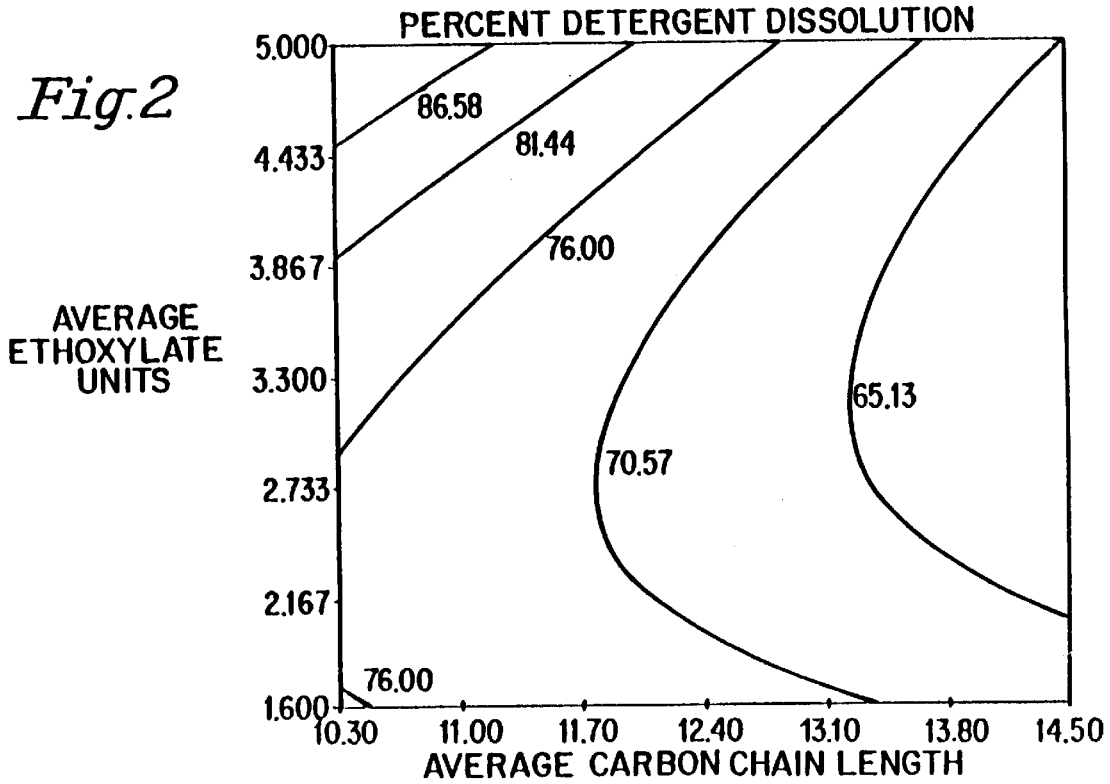

FIG. 2 is a graphic representation similar to FIG. 1, which illustrates the effect of average carbon chain length in nonionic/anionic surfactant compounds on laundry detergent solids dissolution, relative to the average number of ethoxylate groups in the same nonionic/anionic surfactant compounds.

The FIG. 1 and FIG. 2 graphic representations have correspondence with the comparative test data described in Example II.

EXAMPLE I

This Example illustrates the preparation of a partially sulfated ethoxylated alcohol surfactant blend, and its utility in a powder laundry detergent product in accordance with the present invention.

Neodol 23-3[(1)] (321 g) is admixed with 99% sulfuric acid (130 g) in a reaction vessel, and the admixture is stirred for about 30 minutes. The exothermic sulfation reaction increases the reaction medium temperature, and the temperature is controlled in the range of 120°–135° F. during the reaction period.

[(1)] Ethoxylated $C_{12}$–$C_{13}$ alchohol (n=3); Shell Chemical Company

The partially sulfated product has a content of about 63% of sulfated ethoxylated alcohol, with the remainder being unsulfated Neodol 23-3 ethoxylated alcohol.

The liquid partially sulfated surfactant product is neutralized by dry blending the surfactant product in a V-shell blender with sodium carbonate powder, and then with other constituents of a powder laundry detergent formulation. The content of partially sulfated surfactant ingredient in the laundry detergent is about 8 weight percent.

EXAMPLE II

This Example illustrates the comparative effects on the cold water residue properties of a powder laundry detergent composition by different partially sulfated and neutralized ethoxylated alcohol surfactant blends, when each surfactant blend is a respective ingredient in the detergent composition.

For purposes of the comparative solubility tests, a Buchner funnel is thermostated to 40° F. in a water bath. A 10 gram sample of detergent powder is employed in all the tests. A detergent sample is placed in the funnel, and 175 ml of hard water at 40° F. is forced into the funnel through a tube attached to the bottom of the funnel. The water is driven into the funnel by a peristaltic pump.

After an initial one minute soak, a stirrer is activated to disperse the lump formation. The initial stirring is for a five second period. A longer soak period (two minutes and fifty five seconds) is conducted, followed by stirring at 150 rpm for five minutes. The water then is withdrawn through the bottom of the funnel by a vacuum line/trap. The undissolved solids remaining in the funnel are collected in a plastic weighing dish and dried in a 65° C. oven. The solids are weighed, and the weight percent of the undissolved solids is calculated.

The Table is a summary of comparative data for detergent samples using the Buchner Funnel Test. A 175 ml quantity of 125 ppm $CaCO_3$ water at 40° F. is utilized. The data is fitted to a modified cubic equation using DESIGN-EXPERT 3.0. A fit of $r^2$=0.9721 is obtained. The data is plotted at constant ethoxy moles (3) in FIG. 1, and at constant conversion (58%) of ethoxylated alcohol to ethoxy sulfate salt in FIG. 2.

Each of the detergent powder samples consists of sodium carbonate which is dry blended with 15 weight percent of partially sulfated ethoxylated alcohol.

A Neodol 23-3 derived partially sulfated surfactant blend exhibits superior carbonate-solubility properties as compared to a Neodol 25-3 derived partially sulfated surfactant blend.

TABLE

| Ethoxylated Alcohol Surfactant Sample/ % Ethoxy Sulfate | % Dissolved (avg. of 4 replicates) | Standard Deviation |
|---|---|---|
| A/50 | 75.6 | 3.02 |
| B/70 | 80.9 | 0.69 |
| C/60 | 66.2 | 2.04 |
| D/60 | 74.9 | 2.21 |
| E/50 | 69.0 | 1.50 |
| F/70 | 56.6 | 4.65 |
| G/70 | 61.3 | 4.23 |
| H/50 | 88.3 | 1.62 |
| I/70 | 83.5 | 2.12 |
| J/70 | 65.6 | 3.96 |
| K/50 | 74.8 | 3.48 |
| L/60 | 70.1 | 2.13 |
| M/60 | 70.6 | 2.00 |

| | |
|---|---|
| A $C_{14}$–$C_{16}$ (2.5 EO) | H $C_{10}$–$C_{12}$ (4.0 EO) |
| B $C_{10}$–$C_{12}$ (4.0 EO) | I $C_{10}$–$C_{12}$ (1.6 EO) |
| C $C_{12}$–$C_{14}$ (3.0 EO) | J $C_{14}$–$C_{16}$ (5.0 EO) |
| D $C_{10}$–$C_{12}$ (3.0 EO) | K $C_{12}$–$C_{14}$ (3.0 EO) |
| E $C_{14}$–$C_{16}$ (5.0 EO) | L $C_{12}$–$C_{14}$ (4.5 EO) |
| F $C_{14}$–$C_{16}$ (2.1 EO) | M $C_{12}$–$C_{14}$ (2.0 EO) |
| G $C_{12}$–$C_{14}$ (3.0 EO) | |

EXAMPLE III

This Example illustrates the preparation of a granular laundry detergent composition which has improved cold water properties in accordance with the present invention.

Following the general procedure described in the specification, a granular laundry detergent product is prepared which is composed of the following ingredients:

| Ingredient | weight % |
|---|---|
| sodium carbonate | 78.000 |
| sodium Neodol 23-3 sulfate[1] | 5.845 |
| Neodol 23-3 | 3.245 |
| sodium sulfate | 2.025 |
| sodium bicarbonate | 2.124 |
| Acusol 912N[2] | 0.612 |
| sodium carboxymethylcelulose[3] | 0.115 |
| sodium tripolyphosphate | 1.130 |
| optical brightener[4] | 0.280 |
| perfume | 0.124 |
| water | 6.500 |
| | 100.000 |

[1]Ethoxylated (n = 3) $C_{12}$–$C_{13}$ alcohol sulfate salt (Shell Chemical Company).
[2]Sodium polyacrylate (Rohm & Haas).
[3]Finnfix Inc.
[4]Triazinyl stilbene.

As demonstrated in Example II, the herein formulated detergent composition has superior cold water residue properties, as compared to the same detergent composition which has Neodol 25-3 based nonionic/anionic surfactant blend ingredients, rather than Neodol 23-3 based surfactant ingredients.

The detergent composition is reformulated with the same ingredients, except that 73 weight percent of sodium carbonate and 5 weight percent of potassium carbonate are employed. This second potassium salt-containing detergent composition exhibits further enhancement of sodium carbonate solubility properties, as compared to the first detergent composition under cold water fabric laundering conditions.

The herein formulated detergent compositions also exhibit an advantageous balance of sudsing and detergency under cold water fabric laundering conditions.

What is claimed is:

1. A powder laundry detergent composition with improved cold water residue properties, which is a granulated blend of ingredients comprising (1) between about 40–90 weight percent of a water-soluble detergent builder ingredient wherein at least 72 weight percent of the detergent builder ingredient is sodium carbonate; and (2) between about 5–40 weight percent of a detergent active ingredient which is a surfactant blend comprising (a) between about 40–80 weight percent, based on the surfactant weight, of an anionic salt compound corresponding to the formula:

$$R—O—(CH_2CH_2O)_n—SO_3M$$

where R is a $C_{12}$–$C_{13}$ alkyl group, n is an average number of ethoxylate groups between about 1–9, and M is an alkali metal or ammonium cation, and (b) between about 20–60 weight percent, based on surfactant weight, of a nonionic compound corresponding to the formula:

$$R—O—(CH_2CH_2O)_n—H$$

where R is a $C_{12}$–$C_{13}$ alkyl group, and n is an average number of ethoxylate groups between about 1–9; (3) between about 0–12 weight percent of water-soluble inorganic potassium salt; and (4) less than about 4, 5 weight percent of phosphate.

2. A laundry detergent composition in accordance with claim 1 which contains between about 1–15 weight percent of alkali metal silicate corrosion inhibitor.

3. A laundry detergent composition in accordance with claim 1 wherein the detergent builder ingredient comprises a mixture of sodium bicarbonate and sodium carbonate.

4. A laundry detergent composition in accordance with claim 1 wherein the detergent builder ingredient comprises a mixture of sodium sesquicarbonate and sodium carbonate.

5. A laundry detergent composition in accordance with claim 1 wherein the detergent active ingredient is a surfactant blend in which n is an average number of ethoxylate groups between about 2–6.

6. A laundry detergent composition in accordance with claim 1 wherein the detergent active ingredient is a surfactant blend in which the R alkyl group in the anionic and nonionic formulas represents a $C_{12}$–$C_{13}$ alkyl mixture.

7. A laundry detergent composition in accordance with claim 1 wherein the detergent active ingredient is a surfactant blend which contains between about 50–65 weight percent of anionic sulfate salt compound, based on surfactant weight.

8. A laundry detergent composition in accordance with claim 1 wherein the potassium salt ingredient is between about 0.5–10 weight percent of inorganic potassium salt.

9. A laundry detergent composition in accordance with claim 1 wherein the potassium salt ingredient is between about 0.5–10 weight percent of an inorganic salt selected from the group consisting of potassium carbonate, potassium bicarbonate, potassium chloride and potassium sulfate.

10. A laundry detergent composition in accordance with claim 1 wherein the phosphate salt ingredient is between about 0.1–4.5 weight percent of sodium phosphate or potassium phosphate or a mixture thereof.

* * * * *

UNITED STATES PATENT AND TRADEMARK OFFICE

CERTIFICATE OF CORRECTION

PATENT NO. : 6,265,369 B1
DATED : July 24, 2001
INVENTOR(S) : Falotico et al.

It is certified that error appears in the above-identified patent and that said Letters Patent is hereby corrected as shown below:

Title page,
Related US Application Data, replace "[63] Continuation-in-part of application No. 08/936,182, filed on May 9, 1995." with the following:

-- [63] Continuation-in-part of application No. 08/436,182, filed on May 9, 1995. --

Column 1,
Line 9, change "08/936,182" to -- 08/436,182 --

Signed and Sealed this

Twenty-ninth Day of January, 2002

*Attest:*

*Attesting Officer*

JAMES E. ROGAN
*Director of the United States Patent and Trademark Office*